US008944121B2

(12) United States Patent
Huitorel et al.

(10) Patent No.: US 8,944,121 B2
(45) Date of Patent: Feb. 3, 2015

(54) FILLING MACHINE PROVIDED WITH A CLEANING IN PLACE DEVICE WITH INDIVIDUAL COLLECTING ELEMENTS

(75) Inventors: Mickael Huitorel, Octeville sur Mer (FR); Eric Le Berre, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 489 days.

(21) Appl. No.: 13/498,670

(22) PCT Filed: Sep. 29, 2010

(86) PCT No.: PCT/EP2010/064482

§ 371 (c)(1),
(2), (4) Date: Mar. 28, 2012

(87) PCT Pub. No.: WO2011/039270

PCT Pub. Date: Apr. 7, 2011

(65) Prior Publication Data

US 2012/0180904 A1 Jul. 19, 2012

(30) Foreign Application Priority Data

Sep. 29, 2009 (FR) ..... 09 04646

(51) Int. Cl.
*B65B 1/04* (2006.01)
*B67C 3/00* (2006.01)

(52) U.S. Cl.
CPC ..... *B67C 3/004* (2013.01)
USPC ..... 141/90; 141/91; 141/250; 53/276

(58) Field of Classification Search
CPC .... B65B 2210/08; B67C 3/001; B67C 3/002; B67C 3/004; B67C 3/005
USPC ..... 141/89, 90, 91, 250, 269; 53/276, 272
See application file for complete search history.

(56) References Cited

U.S. PATENT DOCUMENTS

| | | | | |
|---|---|---|---|---|
| 4,024,896 | A | 5/1977 | Ishioka et al. | |
| 8,261,783 | B2 * | 9/2012 | Macquet et al. | 141/90 |
| 8,291,945 | B2 | 10/2012 | Maubois et al. | |
| 8,365,780 | B2 | 2/2013 | Meinzinger | |

FOREIGN PATENT DOCUMENTS

| | | | |
|---|---|---|---|
| CN | 101415636 | A | 4/2009 |
| CN | 101445212 | A | 6/2009 |
| CN | 201276411 | Y | 7/2009 |
| EP | 2110359 | A1 | 10/2009 |
| FR | 2911594 | A1 | 7/2008 |
| WO | 2007019590 | A2 | 2/2007 |
| WO | 2007070222 | A1 | 6/2007 |

* cited by examiner

*Primary Examiner* — Jason K Niesz
(74) *Attorney, Agent, or Firm* — Bachman & LaPointe, P.C.

(57) ABSTRACT

A machine for filling containers, including a plurality of filling spouts, and a cleaning device comprising a plurality of individual tubular collecting elements rigidly mounted on a collection tube, and a device for moving the collection tube between a retracted position and a service position in which the collecting elements are in contact, via the upstream ends thereof, with the filling spouts. The collection tube laterally supports the collecting elements, such that, in the retracted position, the collecting elements are arranged between the filling spouts. The moving device capable of moving the collection tube from the retracted position thereof to the service position thereof by at least one downward vertical translational movement, followed by a horizontal movement.

13 Claims, 8 Drawing Sheets

FILLING MACHINE PROVIDED WITH A CLEANING IN PLACE DEVICE WITH INDIVIDUAL COLLECTING ELEMENTS

BACKGROUND

This invention relates to a filling machine provided with a cleaning in place device. The invention relates more particularly to a rotating machine provided with a plurality of filling spouts for the filling of hollow containers, such as bottles or pots, with any sort of products, liquids to viscous, in particular a food product, the cleaning device comprising individual collecting elements associated to said filling spouts.

Such rotating filling machines conventionally include a rotating carrousel carrying a filling product tank and a plurality of filling stations, each filling station comprising a filling spout connected to the tank, a system for support making it possible to support a container under the filling spout, and dosing means in order to deliver a determined quantity of filling product into each container.

Such machines must be cleaned on a regular basis using a cleaning agent, such as a cleaning solution (soda, acid, water or disinfectant) or pressurised steam, which is made to circulate in the machine instead of the filling product, in order to remove any trace of the product and/or any biological or bacteriological contaminants.

In order to limit the consumption of cleaning agent or prevent fouling of the interior of the machine, in particular the lower plate, or in order to allow for the passage of pressurised steam, it is known to provide cleaning in place devices, called CIP devices, allowing for the recovery of the cleaning agent at the output of the filling spouts in terms of its circulation in a closed circuit.

These cleaning devices can include, such as described in patent FR 2 899 220, a plurality of individual collecting elements, such as tubes or vessels, each collecting element able to be moved vertically between a high service position wherein the collecting element comes into contact in a sealed manner with a filling spout in order to recover in their internal passage the cleaning agent delivered by said spout, and a retracted low position wherein said collecting element is separated from said filling spout in order to allow for the filling of containers. The collecting elements are connected to the same annular collection tube mounted mobile on a fixed frame in order to move all of the collecting elements between their two positions by vertical translation. Machines for filling are conventionally associated with cleaning in place units, called CIP units, which are used to prepare cleaning solutions, send the cleaning solutions into the tank of the filling machine, then recover them, and possibly recycle them. For the recovery of the cleaning solutions, the collection tube is connected to an intermediary recovery tray, provided with a pumping system and valves to evacuate the cleaning solution towards the cleaning unit.

In retracted low position the collecting elements must be arranged under the containers to be filled. The vertical travel between the two positions is relatively substantial, and the cleaning device has a substantial encumbrance in the lower portion of the machine. Cumbersome and complicated means for moving and guiding are required to carry out this vertical travel and guarantee a correct movement of all of the collecting elements in high position. Their presence congests the plate of the machine, complicating its cleaning in case of accidental fouling.

The collecting elements can come to all fit together on cylindrical portions of the filling spouts, sealing means formed of wiper seals then being provided in order to provide sealing. Such recovery tubes, provided with wiper seals and coming to fit onto the spouts, provide a good sealing, even when the machine comprises a large number of filling spouts, with differences in height between the spouts. However, their encumbrance may be incompatible with conventional systems for supporting containers.

Collecting elements provided at the upper end with an O-ring able to come to bear against the tapered exterior surface of the filling spout or against the lower annular edge surrounding the discharge opening of the spout can also be provided. Such a seal with an O-ring cannot be correctly provided on a machine provided with a large number of filling spouts, as in practice, the differences in height between the filling spouts cannot be compensated by the crushing of an O-ring.

In the aforementioned patent, it was proposed to provide the collecting elements with deformable tubular tips able to decrease axially in length elastically in order to offset the differences in height between the filling spouts. These tubular tips cannot however be used in certain cases, in particular according to the type of filling spout and/or the type of system for support.

SUMMARY OF THE INVENTION

The objective of this invention is to propose a filling machine with a cleaning device overcoming at least one of the aforementioned disadvantages.

To this effect, the subject of the present invention is a machine for filling containers comprising

- several filling stations each comprising a filling spout connected to means of distributing filling liquid, and
- a cleaning device comprising
  - several individual tubular collecting elements, each collecting element comprising an internal passage extending from an upstream end to a downstream end, and able to come into contact via its upstream end against a filling spout in order to carry out cleaning operations,
  - a collection tube whereon are mounted rigidly said collecting elements by their downstream end to collect the cleaning agent recovered by said collecting elements,
  - moving means able to move said collection tube between a service position wherein the individual collecting elements are in contact via their upstream end against the filling spouts in order to recover in their internal passage a cleaning agent delivered by said spouts, and a retracted position wherein said collecting elements are separated from the filling spouts in order to allow for the filling of containers placed under the filling spouts, characterised in that said collection tube laterally carries said individual collecting elements in such a way that, in the retracted position of the collection tube, said collecting elements are arranged between the filling spouts, the moving means able to move said collection tube from its retracted position to its service position via at least one movement in vertical translation downwards, parallel to the longitudinal axes of the filling spouts, followed by a horizontal movement, perpendicularly to the longitudinal axes of the filling spouts, in such a way that the upstream end of each collecting element is substantially centred according to the longitudinal axis of a filling spout.

Thus, according to the invention, the collecting elements are arranged between the filling spouts, and the movement of the collection tube between its two positions is carried out by combining a vertical movement and a horizontal movement. Such a movement requires little space under the filling spouts and makes it possible to limit the travel of movement between the service position and the retracted position, which makes it possible to reduce the risks of positioning defaults between the spouts and the collecting elements, to use moving means which are simple in design and manufacture and which take up little space, and thus to propose filling machines of reduced height. As the distance between the spouts and the collection tube is reduced, the path taken by the cleaning agent between the spouts and the outlet of the collection tube is reduced, which decreases the losses of head and the surfaces to be cleaned, thus improving the quality and the cleaning time.

Moreover, in service position, the collection tube according to the invention can be arranged at a height which allows for a return of the cleaning solutions towards a cleaning unit, via simple gravity, without requiring an intermediary tray with pumping system and valves. The suppression of this intermediary tray makes it possible to install the cleaning unit in the vicinity of the filling machine, and to thus incorporate the automatic devices of the machine and of the cleaning unit into a shared electric cabinet.

Advantageously, at least the collecting elements, and more preferably the collecting elements and the collection tube, are arranged substantially on or above the lower edges of the filling spouts in the retracted position of the collection tube.

According to an embodiment, in order to bring the collection tube into service position, the horizontal movement is followed by a movement in vertical translation upwards, parallel to the longitudinal axes of the filling spouts.

The machine according to the invention can be of linear type with a substantially linear collection tube arranged parallel to the filling spouts, or of the rotating type.

According to an embodiment, the machine is of the rotating type, said filling stations being arranged at regular angular intervals on a support structure mounted rotatingly on a fixed frame, said collection tube is of a generally annular shape and laterally carries, on the interior side or on the exterior side of the circle described by the filling spouts, at regular angular intervals, the individual collecting elements, said collection tube being mounted mobile on said support structure via said moving means, said moving means being able to move the collection tube in vertical translation and in rotation, said horizontal movement consisting in a rotation around the axis of rotation of the support structure, on an angle corresponding to a maximum of one half pitch between two successive filling spouts.

According to an embodiment, each individual collecting element comprises a first vertical tube, of vertical axis, comprising an open upper end constituting said upstream end of the collecting element and a lower end closed by a substantially horizontal wall, and a second tube, more preferably substantially horizontal, integral with the first tube, of which the internal passage exits via a first end into the internal passage of the first tube, its second end constituting the second end of the collecting element through which the latter is fixed radially to the annular collection tube. This particular structure makes it possible to obtain collecting elements having a reduced vertical encumbrance, facilitating their disposition above the lower edges of the filling spouts in the retracted position of the collection tube.

More preferably, the annular collection tube and the second tubes are of substantially circular section, the second tubes being more preferably fixed tangentially to the lower wall of the collecting element and/or tangentially to the wall of the collection tube, in such a way that the bottoms of the collection tube and of the second tubes are substantially arranged according to the same plane. Advantageously, said second tube extends radially towards the interior from the collection tube, the collection tube being arranged on the exterior side of the circle described by the axes of the filling spouts. Inversely, the second tube can extend radially towards the exterior, the collection tube being arranged on the interior side of the circle described by the filling spouts.

According to an embodiment, the collection tube comprises an evacuation outlet, the collection tube comprising two symmetric branches, of a generally semi-annular shape, extending from said evacuation outlet, and being connected at their opposite end to said evacuation outlet,

- the internal passage of each branch having a transversal section increasing from its opposite end to said outlet, in the direction of said evacuation outlet, and/or
- said ends of the branches are closed, and advantageously connected rigidly together by a solid rod.

Thus, the section of the collection tube increases advantageously progressively with the flow as the filling spouts deliver their individual flow of cleaning agent, which makes it possible to provide a sufficient flow velocity, for example between 1 and 2 m/s, to obtain a good cleaning of the collection tube, without fouling over time. Moreover, the collection tube is more preferably not entirely closed on itself, the two branches not being in fluid communication on their ends, in such a way as to oblige the cleaning agent to circulate in an imposed direction and thus to suppress any zone of stagnation in the collector tube, in particular between the two collecting elements opposite the evacuation outlet, which would lead to fouling over time.

According to an embodiment, the moving means include at least two carriages to which is assembled the collection tube, the collection tube being assembled to each carriage by at least one vertical raising/lowering cylinder, in order to provide the movements in vertical translation of the collection tube, said carriages being mounted slidingly on a horizontal circular guiding rail integral with the rotating support structure, at least one swing cylinder being mounted between the support structure and a carriage in order to provide for the movement in rotation of the collection tube.

According to an embodiment, the machine comprises a general evacuation device integral with the fixed frame, comprising an evacuation tube, arranged more preferably on the exterior side of the collection tube and, able to come substantially to face the evacuation outlet of the collection tube when the collection tube is in service position and the support structure in a given fixed position, said evacuation tube being able to be moved in horizontal translation between a separated position and an active position wherein it comes to connect onto the evacuation outlet of the collection tube.

According to an embodiment, said upstream end of each collecting element is provided with sealing means through which said collecting element comes into contact with a filling spout, in order to guarantee the sealing between the filling spout and the collecting element in its service position, said sealing means comprising more preferably an annular inflatable membrane mounted at the upstream end of the collecting element and able to come in contact with the filling spout when it is in an inflated state and the collection tube is in its service position. The annular inflatable membranes make it possible to effectively compensate the positioning defaults of the individual collecting elements in relation to their respective filling spouts, i.e. the differences in height between the filling spouts and/or the differences in height between the collecting elements, and/or the alignment defaults of their vertical axes, and therefore to guarantee a sealed connection of all of the collecting elements of the machine with the filling spouts.

According to an embodiment, the annular inflatable membrane is able to come to bear against the lower edge of the filling spout, around the discharge opening, the membrane allowing to pass through its centre the cleaning agent exiting from the filling spout. According to another embodiment, said inflatable membrane is able to come laterally tighten the cylindrical wall of the filling spout. In this embodiment, the thrusting pressure is supported only by the filling spout. During cleaning operations, the membrane does not exert any vertical force on the filling spout, and it is therefore not necessary to reinforce the structure supporting the filling spouts, or that supporting the collecting elements. Moreover, the filling spouts can thus be easily carried directly by their supply ducts fixed rigidly in the lower portion of the distributing means, formed for example of a central tank, the dosing means being advantageously directly carried by the filling spout.

According to an embodiment, the inflatable membrane of a collecting element is mounted on the upper edge of the first tube of the collecting element by means of at least one flange fixed on said first tube by means of screws or threaded rods, and tightened from the upper edge of the flange, and/or tightened, where applicable by means of nuts, by the lower edge of said first tube, after insertion of screws or threaded rods in longitudinal bores of said first tube. Thus, the inflatable membranes can be easily mounted and dismounted.

According to an embodiment, each filling station comprises a container support device, comprising more preferably at least one retaining element able to cooperate with the neck of a container, such as a clip, said support structure of the machine comprising an upper column carrying at its upper end, possibly via a support crown, the distributing means and the filling spouts, and a lower column carrying the support devices, and wherein is mounted slidingly the first column, the upper column being able to be moved between a low position for the filling operations and a high position to separate said support devices, in particular said retaining elements, from the filling spouts for the cleaning operations.

The machine can advantageously include centring means of the collection tube in the retracted position and in the service position, these centring means being formed for example by stops on the guiding rail and/or by means integral with the support structure which cooperates with additional means integral with the collection tube.

BRIEF DESCRIPTION OF THE DRAWINGS

The invention shall be better understood, and other details, characteristics and advantages shall appear more clearly during the following detailed explanatory description of a currently preferred particular embodiment of the invention, in reference to the annexed diagrammatical drawings, wherein.

DETAILED DESCRIPTION OF THE PREFERRED EMBODIMENT(S)

Figure 1A:
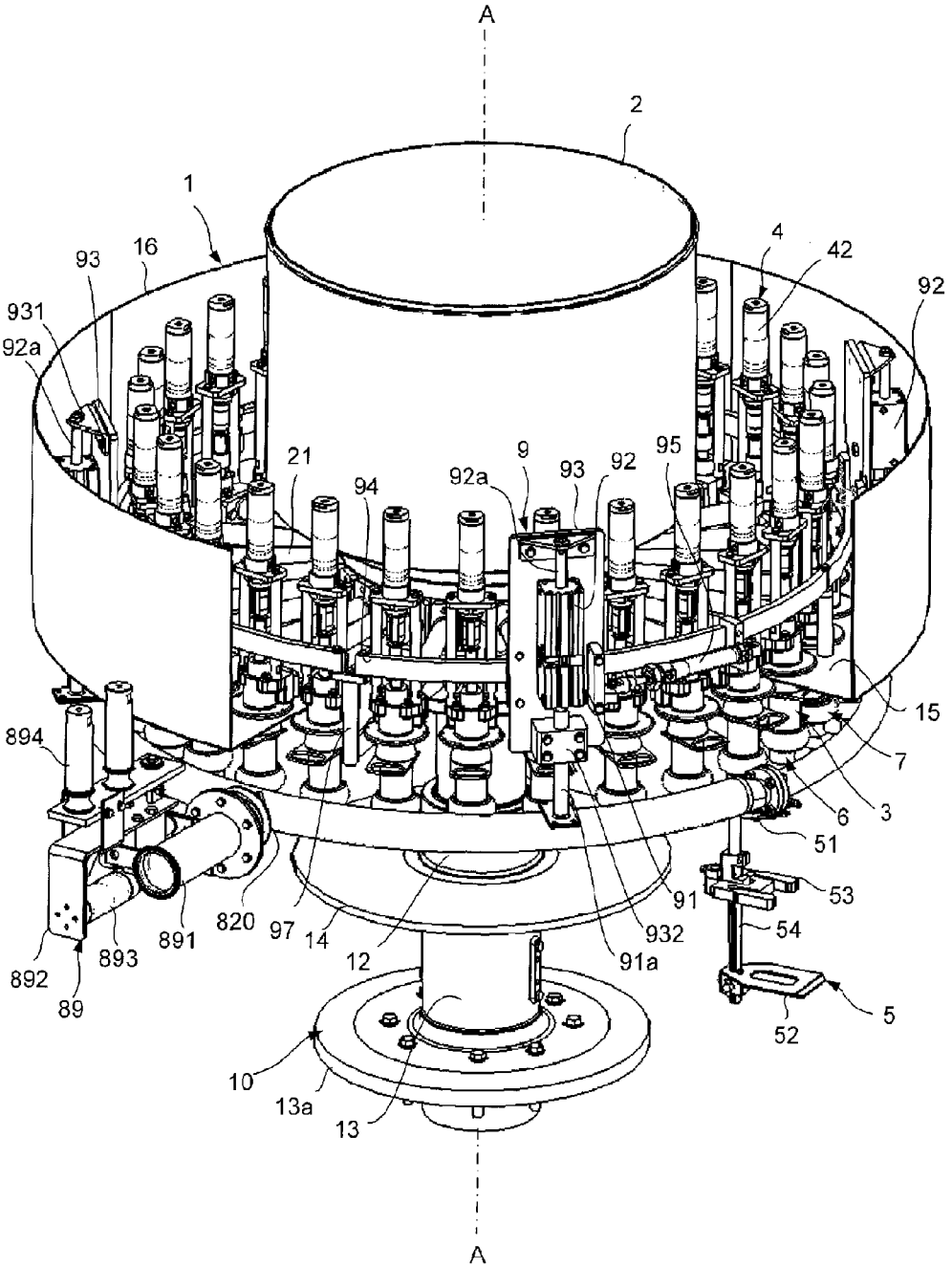
FIGS. 1A and 1B show two perspective views of a rotating filling machine according to the invention, provided with a cleaning device, the collection tube carrying the individual collecting elements being in service position.
Figure 1B:
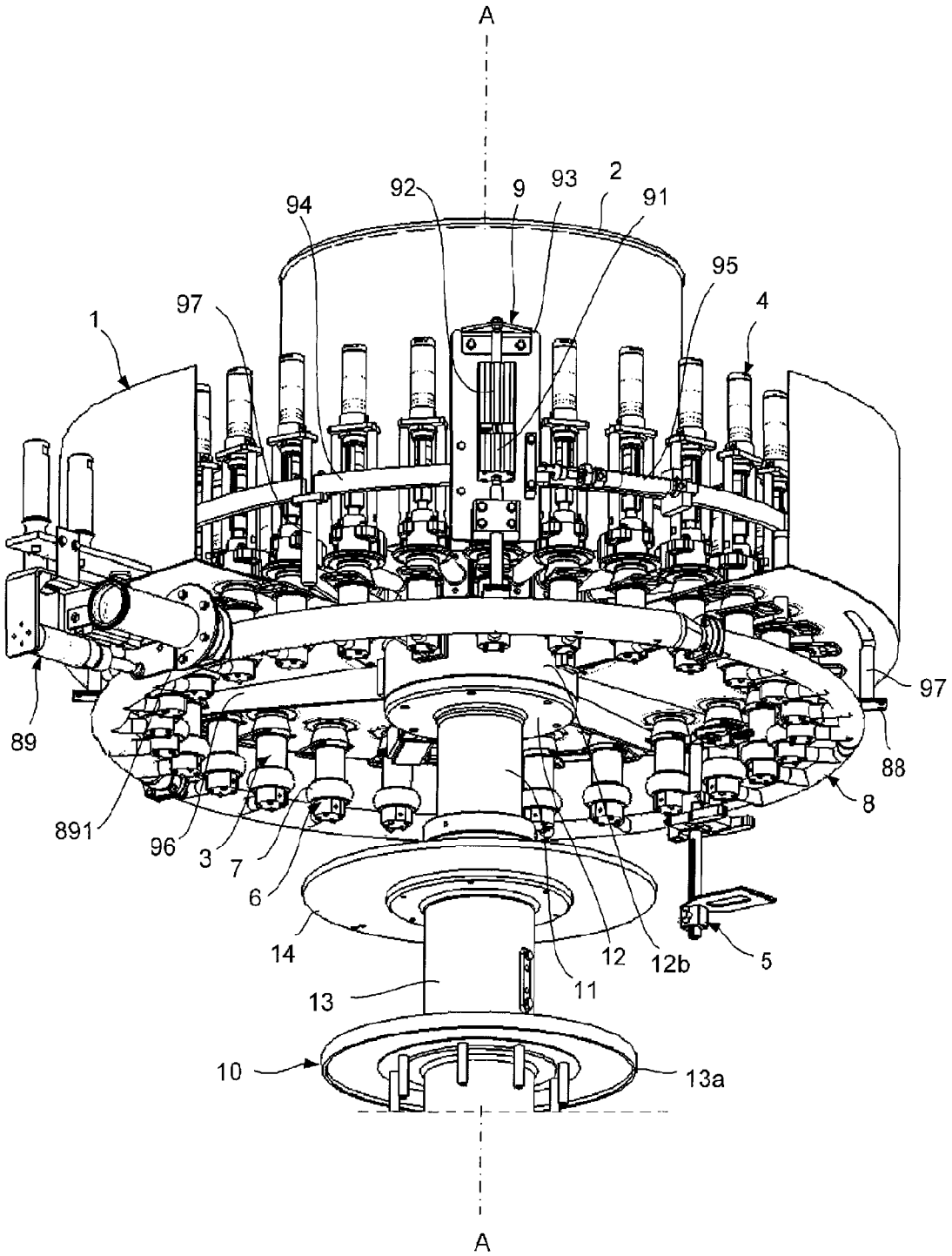

In the embodiment shown in the figures, in reference in particular to FIGS. 1A and 1B, the filling machine is of the rotating type, and comprises a carrousel 1 comprising a support structure 10, intended to be mounted rotating on a fixed frame (not shown) around an axis A of vertical rotation. The support structure carries means of distributing filling liquid formed here by a central cylindrical tank 2, and a plurality of filling stations arranged at regular angular intervals around the axis A. The support structure comprises an upper column or drum 11, provided at its upper end with a support crown 12 whereon is mounted a raising cylinder 12*b* supporting the tank, this upper column being mounted slidingly in a lower column 13 provided with a base 13*a* through which the support structure is mounted on the fixed frame. The two columns are integral in rotation, the upper column 11 being able to be moved vertically via suitable means between a high position and a low position, such as described hereinafter.

Each filling station comprises a filling device comprising a spout 3 with a discharge opening in fluid communication with the tank 2, and dosing means 4 in order to deliver a determined quantity of filling product in each container brought under the spout, the filling station further comprising a device 5 for supporting a container R, here a bottle, for the retaining of a container under the spout.

Figure 3:
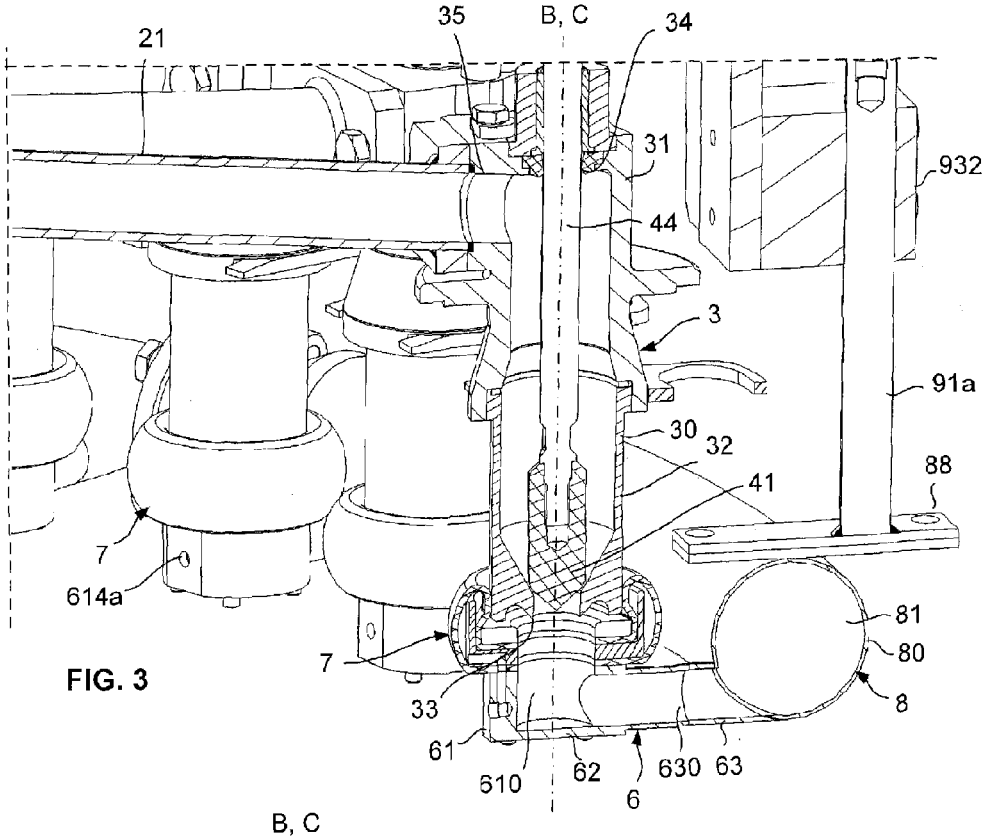
FIG. 3 shows a partial enlarged cross-section view of the FIG. 1A, according to a radial section plane passing through a collecting element, showing the inflatable membrane of said collecting element in an inflated state, in contact with a filling spout.
Figure 4:
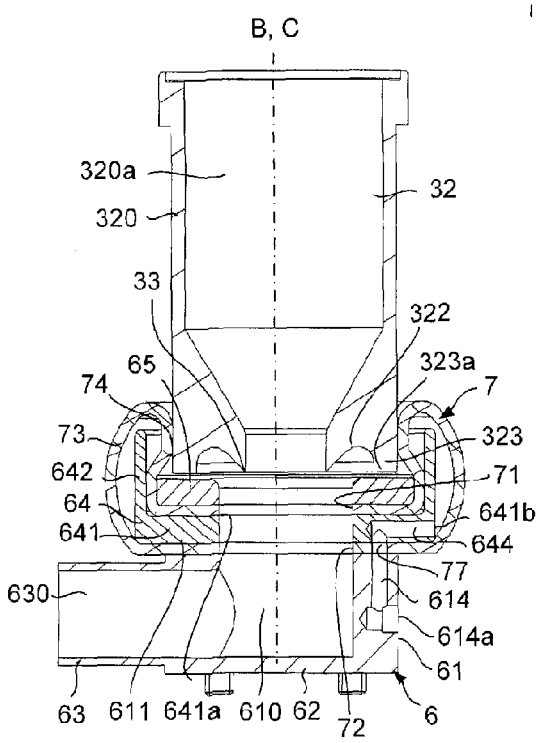
FIG. 4 shows a partial enlarged view of the filling spout and of the associated collecting element of FIG. 3.

In reference to FIGS. 3 and 4, the spout 3, of longitudinal axis C, is formed of a globally tubular body 30 having an internal passage, an upper open axial end 34 and an open lower axial end constituting the discharge opening 33 of the filling spout. The tubular body is provided with a radial supply opening 35. A supply duct 21 is connected to the supply opening 35 for the supply of the filling spout with filling product. The supply ducts of all of the spouts are connected on one side to a filling spout and on the other side to the tank. In this embodiment the spouts are carried by the supply ducts fixed to the tank.

The tubular body 30 is constituted of two parts in order to facilitate the assembly and disassembly of the spout: a first part 31, provided with the upper axial end 34 and the supply opening 35, through which said body is mounted on the support structure, and a second part 32 provided with the discharge opening 33, which is mounted in a removable manner on the first part.

This second part 32 has exteriorly a wall 320 of cylindrical shape. Its internal passage 320*a* has from bottom to top a cylindrical upper segment, a tapered segment tapering progressively downwards, and a cylindrical lower segment delimited by the discharge opening. Thus the cylindrical wall has a greater thickness on tapered segments and lower segment, and an annular groove 322 is arranged on the lower edge of this second part in the thickness of the cylindrical wall, this groove forming an exterior skirt 323 around the discharge opening.

The dosing means 4 include a shutter system comprising a valve 41 arranged in the spout. This valve is controlled in opening and in closing by a control system comprising a cylinder 42, for example pneumatic. The body of the cylinder is mounted on the first part of the spout and the valve 41 is connected to its rod 44, in such a way that the valve can be moved in vertical translation by the cylinder between a closed position, shown in FIG. 3, in order to close the discharge opening, and one or several open positions in order to open the discharge opening.

In reference to FIG. 1A, the device 5 for supporting a container R, known per se, is mounted at regular angular intervals on a ring 14 by assembling means (not shown), this ring being fixed to the second column 13, under the tank. The support device comprises for example a clip 51 able to grasp the bottle above or below its collar located at the base of its neck, a base 52 for supporting the bottle via its bottom, and an intermediary spacer 53 coming against the cylindrical wall of the bottle. The clip, the base and the spacer are mounted in an adjustable manner on a vertical rod via which the supporting device is mounted on the ring. The dosing means are for example of the weight-based type, the actuating of the cylinder being controlled by a weighing sensor which is placed on container support device associated with the filling station, for example on its assembling means or in place of its assembling means. Alternatively, the cylinder is controlled by a filling level detection sensor of the container or a flow sensor coming to insert itself between the container and the spout at the time of filling or a volumetric metering means.

The cleaning device comprises individual collecting elements 6 mounted on a collection tube 8 of a generally annular shape, also called collection toroid, which is mounted mobile on the support structure 10. The collecting elements are arranged at regular angular intervals on the collection tube and their number corresponds to that of the spouts of the machine.

In reference to FIGS. 3 and 4, each collecting element 6 is formed of a first vertical cylindrical tube 61, of vertical longitudinal axis C, open at its upper end and of which the lower end is closed by a horizontal lower wall 62, and a second horizontal cylindrical tube 63 fixed perpendicularly to the cylindrical wall of the first tube by a first end, the cylindrical wall of the second tube being arranged substantially tangentially to the lower wall 62, the internal passage 630 of this second tube exiting in the internal passage 610 of the first tube. The collecting element 6 is mounted on the collection tube by the second end of its second tube 63, its internal passage 630 exiting onto the internal passage 81 of the collection tube 8. The second tube extends radially towards the interior from the collection tube, the cylindrical wall of the second tube being arranged tangentially to the cylindrical wall of the collection tube, in such a way that the bottom of the second tube is substantially at the same level as the bottom of the collection tube.

The collecting elements are mounted at regular angular intervals on the collection tube, in such a way that the axes C of their first tubes 61 are arranged according to a circle corresponding to that described by the axes B of said spouts, and according to one spacing pitch corresponding to that of the spouts.

The open end of the first tube 61 is provided with sealing means through which the collecting element comes against a spout during cleaning operations in order to recover the cleaning agent in its internal passage which is constituted by the internal passage 610 of the first tube and the internal passage 630 of the second tube.

Figure 5A:
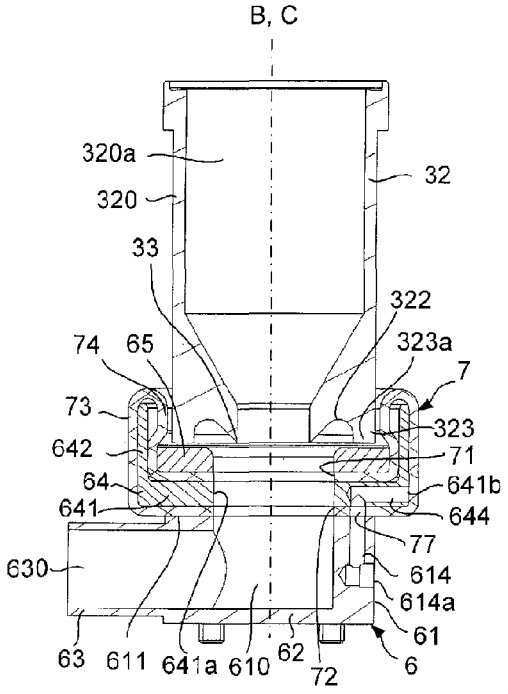
FIG. 5A shows a view analogous to FIG. 4, the membrane being in a deflated or non-deformed state.
Figure 5B:
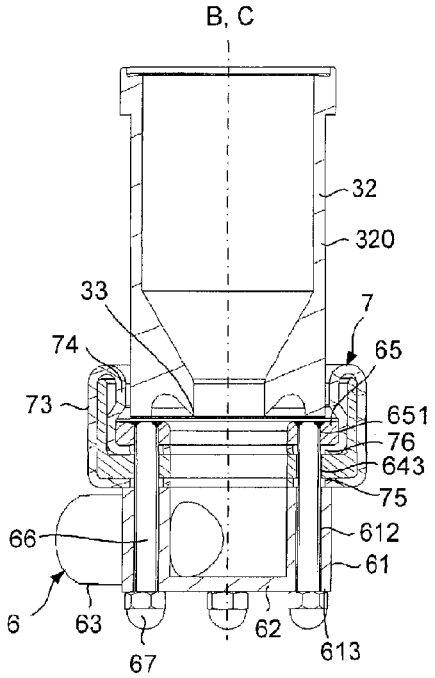
FIG. 5B is a view analogous to FIG. 5A according to another section plane, showing a possible system for fastening through the bottom of the inflatable membrane.

In reference to FIGS. 5A and 5B, the sealing means are formed of an annular inflatable membrane 7 mounted in a sealed manner on the upper edge 611 of the cylindrical wall of the first tube. The mounting of the membrane is carried out by means of a ring 64 comprising a horizontal annular wall 641 continuing on its exterior circular edge 641*b* with a vertical cylindrical wall 642. The membrane can initially have a planar shape, and is folded on the ring in such a way as to bring its two circular edges 71, 72 on either side of the annular wall 641 of the ring, substantially on interior circular edge 641*a*, the membrane mounted on the ring having an external portion 73 on the exterior side of the ring and an internal portion 74 on the interior side of the ring. Alternatively, the ring is moulded and initially has the shape shown in FIG. 5A, with an internal portion and an external portion, the ring then being inserted into the membrane until its interior circular edge 641*a* is brought on circular edges of the membrane.

The ring 64 provided with the membrane is placed against the upper edge 611 of the first tube by its annular wall 641, and is fixed by means of an annular mounting flange 65. The flange 65 is placed on the external portion of the membrane, on the annular wall 641, and tightened by means of threaded rods 66, for example in the number of four. To do this, in reference to FIG. 5B, the cylindrical wall of the first tube is provided with longitudinal bores 612 extending from its lower edge 613 up to its upper edge 611. The threaded rods are for example screwed into threaded holes 651 of the flange 65, then welded on the flange. Each threaded rod is inserted through an opening 76 of the internal portion of the membrane, then passes successively in a vertical bore 643 of the annular wall 641 of the ring, in an opening 75 of the external portion of the membrane, then in a longitudinal bore 612. Blind nuts 67, screwed on the ends of the threaded rods exceeding the lower edge 613, provide the tightening of the membrane on the collecting element. During the tightening of the flange, the internal portion 74 of the membrane is tightened between the flange 65 and the ring 64 and its external portion 73 is tightened between the upper edge 611 and the ring.

Alternatively, the flange can come to thrust the membrane on the first tube by the intermediary of screws inserted from above in the blind threaded holes arranged in the cylindrical wall of the first tube.

Once fixed, the membrane extends vertically upwards over the flange, the cylindrical wall of the ring which extends above the flange serving as a prop retaining the membrane in this vertical position, above the first tube of the collecting element.

In reference to FIGS. 4 and 5A, the inflatable membrane can be inflated by injecting a fluid under pressure passing in a first channel 614 arranged in the thickness of the cylindrical wall of the first tube, and in a second channel 644 arranged in the thickness of the annular wall of the ring and which exits inside the membrane. The first channel 614 extends horizontally towards the interior from the exterior surface of the cylindrical wall of the tube, opposite the second tube 63, then vertically upwards to exit onto the upper edge 611, on an opening 77 arranged in the external portion of the membrane.

The second channel 644 extends horizontally towards the interior from the exterior edge 641*b* of the annular wall of the ring, then vertically downwards to exit onto the lower face of the annular wall, on said opening 77 of the external portion of the membrane. The supply with fluid is carried out from the orifice 614*a*of the first channel on the cylindrical wall. The orifices 614*a* of all of the collecting elements are connected via flexible ducts to a supply system making it possible to simultaneously supply all of the membranes with fluid under pressure.

Each membrane is made from an elastically deformable material, such as an elastomer, for example of the silicone type, EPDM nitrile EPT or EPDM. When the membrane is placed under pressure, it inflates and is deformed such as described hereinafter. The exterior portion 73 of the membrane can be reinforced in order to favour the deformation of the interior portion 74, and obtain a better sealing on the spout.

Figure 6:
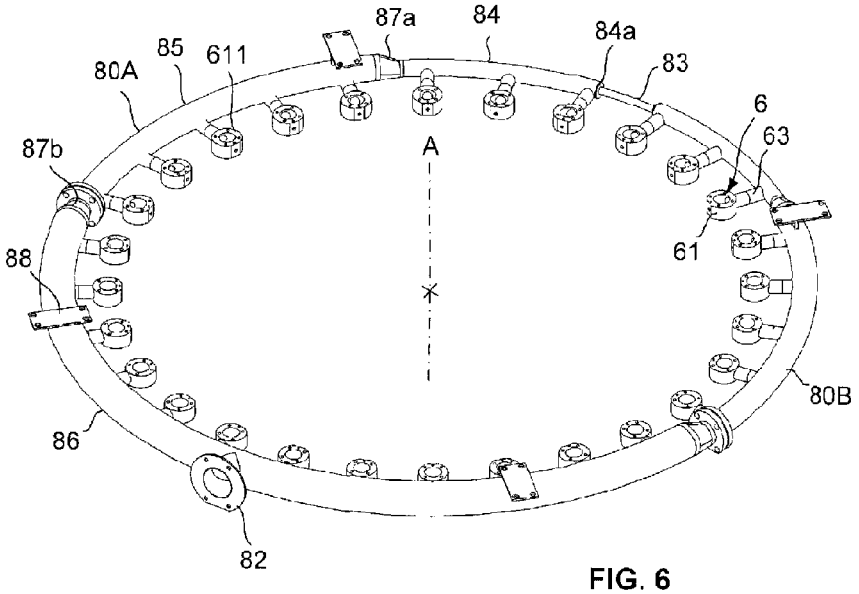
FIG. 6 is a perspective view of the annular collection tube carrying the collecting elements, the latter not being provided with their inflatable membrane.

In reference to FIG. 6, the collection tube 8 comprises a single evacuation outlet 82. The collection tube comprises two symmetric tubular branches 80A, 80B of a generally semi-annular shape, which extend from said outlet 82 and of which the ends 84*a* opposite the outlet are closed. These closed ends 84*a*, are connected together by a solid rigid rod 83 serving for the mechanical resistance of the collection tube. The section of the internal passage of each branch increases from its closed end 84*a* to the outlet. Each branch is formed of several segments of different transversal sections, each segment having a constant transversal section. The first segment 84, the farthest away from the outlet and of smaller section, comprises the closed end 84*a* and is connected by a connector 87*a* to a second segment 85 of transversal section that is greater than the first segment. This second segment is connected by a connector 87*b* to a third segment 86 of a section that is greater than that of the second segment. The third segments 86 of the branches are formed from the same part provided with the evacuation outlet 82. The connectors are advantageously of the eccentric reduction type, in such a way that the bottoms of the segments are arranged substantially according to the same plane. Two collecting elements are mounted on the collection tube as close as possible to the closed ends, on either side of the solid rod.

The length and the section of each segment are adapted for each application to the number of collecting elements that it is carrying, to the number of collecting elements arranged upstream in relation to the direction of flow of the cleaning agent, and to the diameter of the discharge orifices of the spouts, in order to adapt the collection tube to the flow of cleaning agent and guarantee correct cleaning of the totality of the internal wall of the collection tube. By way of example, such as shown in the figures, for a machine with 28 spouts, each first segment, each second segment and each third segment carry respectively 3, 5 and 6 collecting elements. The maximum section of segment is defined by the maximum flow of the cleaning solutions sent into the tank.

The tube 8 is provided with mounting lugs 88 formed of horizontal plates fixed in the upper portion of the tube, for example four lugs arranged at 90° from one another, with a lug on each second portion and each third portion of a branch.

Figure 2A:
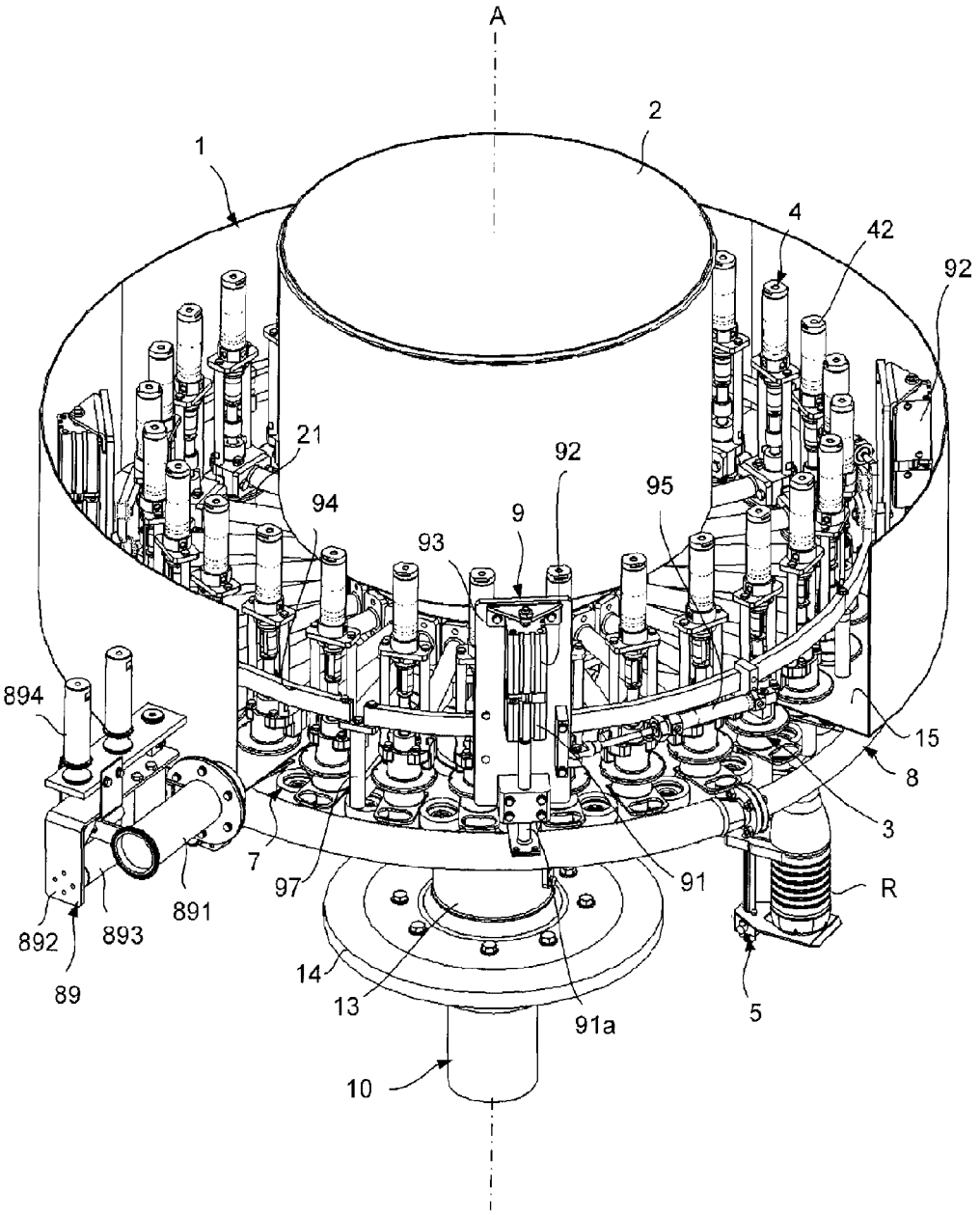
FIGS. 2A and 2B show views analogous to FIGS. 1A and 1B, the collection tube being in retracted position.
Figure 2B:
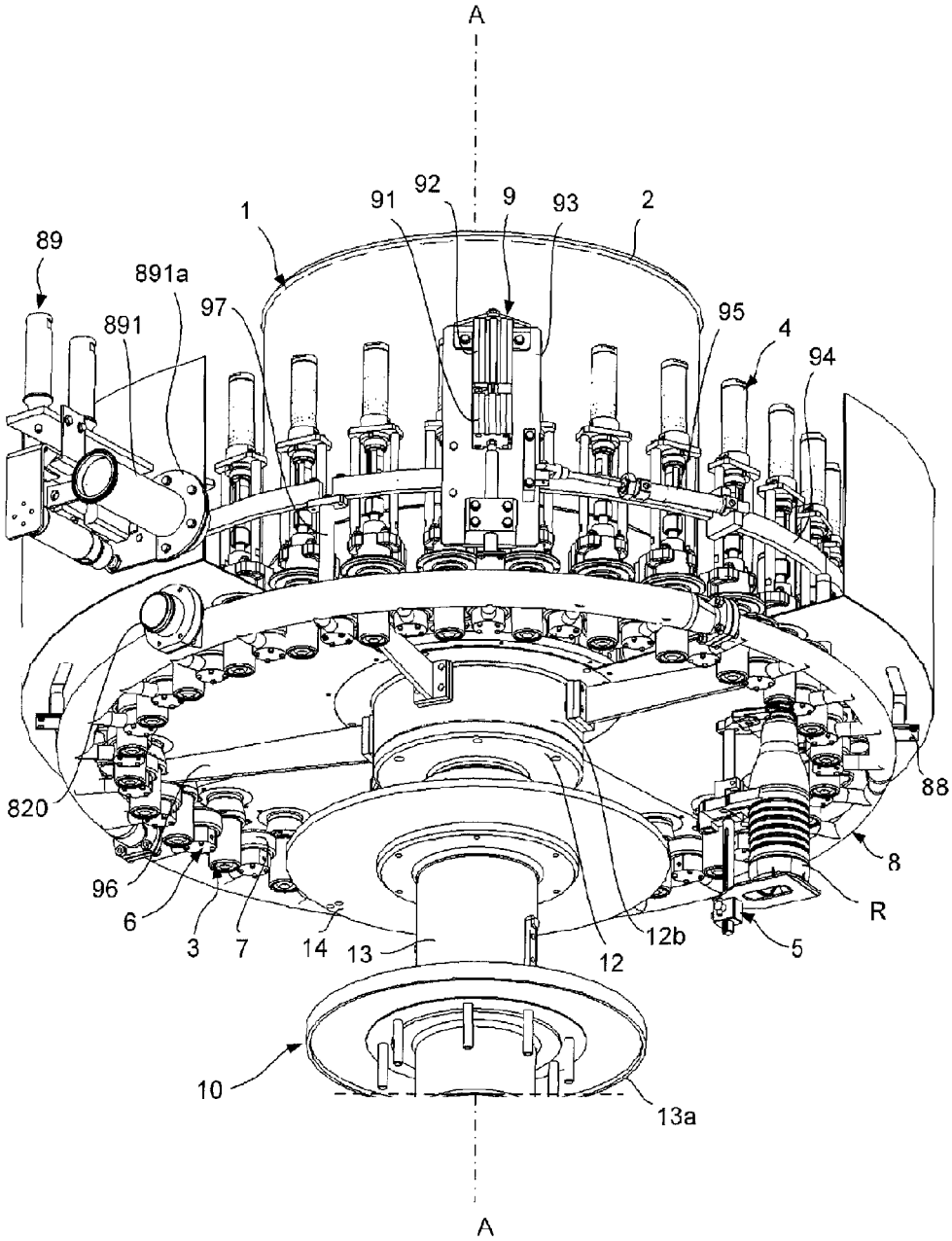

In reference to FIG. 2*b*, the evacuation outlet comprises a horizontal straight outlet tube 820 extending radially towards the exterior from the collection tube.

The collection tube is mounted on the support structure, substantially horizontally, and centred according to the axis A, via its lugs 88, with a moving system 9 which is inserted between its lugs and the tank and which is able to move the collection tube in rotation and in vertical translation.

In reference to FIGS. 1A and 1B, each lug of the crown is connected via two vertical raising/lowering cylinders 91, 92, on a carriage 93, the latter being mounted slidingly on a circular guiding rail 94 fixed horizontally to the support structure, the movement in rotation of the collection tube in relation to the support structure, and around the axis A, being carried out with at least one swing cylinder 95, acting on one of the carriages, for example two swing cylinders acting on two diametrically opposite carriages.

The mounting of the guiding rail 94 is carried out by means of four radial arms 96 mounted on the raising cylinder 12*b*, each arm passing between two filling devices. The free ends of the radial arms are arranged beyond the filling devices and carry vertical rods 97 extending upwards, at the upper ends of which is assembled the rail 94. Each carriage consists globally of a rectangular plate carrying on a face wheels through which the carriage is mounted slidingly on the rail. The two raising/lowering cylinders 91, 92 are mounted on the other face of the plate. The two cylinders are assembled together, back to back. A first upper raising/lowering cylinder 92, has its rod 92*a* which extends upwards, and is assembled via the free end of its rod to a lateral lug 931 in the upper portion of the plate. The rod 91*a* of the other lower raising/lowering cylinder 91, which extends downwards, is connected to a rod which passes in a guide block 932 in the lower portion of the plate, and its free end is fixed to a lug 88. The body of each swing cylinder is assembled pivotingly to the end of an exterior lug fixed to the rail 94, in order to offset the cylinder body towards the exterior, and the free end of its rod is assembled pivotingly to a carriage 93. The machine comprises a protective casing shown partially in the figures, comprising an annular horizontal wall 15 and a cylindrical wall 16.

In a high retracted position, of the collection tube 8, which is shown in FIGS. 2A, and 2B, the spouts 3 are arranged between two collecting elements 6, the collection tube 8 and the collecting elements being arranged above the discharge orifices of the spouts. The first tubes 61 of the collecting elements provided with inflatable membranes are arranged between the second parts 32 of the spouts, their axes C being positioned on the circle described by the axes B of the spouts. The raising/lowering cylinders 91, 92 are each in a retracted position, and the swing cylinders 95 are each in an extension position.

In order to bring the tube 8 into a service position allowing for the recovery of the cleaning agent by the collecting elements 6, the raising/lowering cylinders are in a first step controlled towards their extension position in order to carry out a movement in vertical translation downwards of the collection tube from the retracted high position up to a first low position, wherein the first tubes 61 provided with inflatable membranes are arranged under spouts. The swing cylinders 95 are controlled towards their retracted position in order to move the collection tube in rotation in the anti-clockwise direction on an angle corresponding to one half pitch between two successive spouts, until the collection tube is brought into a second low position wherein the first tubes of the collecting elements are arranged under the spouts, each first tube being substantially centred according to the longitudinal axis B of a spout. During the rotation movement, the discharge orifices 33 pass more preferably extremely close to the membranes, without contact with the latter.

In a third step, the lower raising/lowering cylinders 91 are then controlled in retracted position in order to slightly raise the collection tube from this second low position to a service position, shown in FIGS. 1A, 1B, 5A and 5B, wherein, the membrane of each collecting element, in a deflated state, is arranged around the cylindrical wall 320 of the second part 32 of the spout, the discharge opening 33 and the lower edge 323*a* of the skirt 323 being arranged approximately 2 mm above the flange 65. This service position is defined according to possible clearances of a few tenths of a millimeter in such a way that the spouts are not in contact with the flanges of their associated collecting elements.

In this service position, a fluid under pressure can be injected into the membranes via the orifices 314*a*, in order to inflate the membranes in an inflated state so that they come to press against the cylindrical walls of the spouts, such as shown in FIGS. 1A, 1B, 3 and 5, in order to connect in a sealed manner the collecting elements to the spouts.

Once the cleaning operation is complete, the membranes are deflated by bringing the interior of the membranes to atmospheric pressure, through the putting into communication of supply channels 614, 644 with the atmospheric pressure, and the collection tube is brought into its retracted high position by carrying out the previously described sequence in the reverse order: displacement downwards by vertical translation from the service position to the second low position, rotation clockwise by one half pitch towards the first low position, then movement upwards by vertical translation in the retracted high position.

During the filling operations of containers, the upper column 11 is in low position in order to bring the spouts as close as possible to the containers carried by the support devices integral with the support crown 14, and the collection tube is retained in retracted high position and rotates with the tank and the filling stations. For the cleaning of the machine, the upper column 11 is raised to high position in order to release the spouts from clips 51. The tank is more preferably stopped in rotation. The collection tube 8 is then brought into service position by actuation of cylinders 91, 92, 95, then the membranes are inflated. A cleaning agent is loaded into the filling liquid tank. The valves 41 of the spouts are controlled in open position in order to cause the cleaning agent to circulate in the spouts and recover it by the collecting elements and the collection tube. The membranes will be retained in inflated state throughout the entire duration of the cleaning operation.

In reference to FIGS. 1A and 2B, for the cleaning operations, the carrousel is advantageously stopped in rotation in a given fixed position, in such a way that the outlet tube 820 of the collection tube is arranged to face a general evacuation device 89 when the collection tube is in service position. The general evacuation device comprises an evacuation tube 891 mounted mobile in horizontal translation on a support 892 mounted on the fixed frame of the machine. The evacuation tube can be moved, via a cylinder 893, between a separated position and an active position wherein it comes to engage in a sealed manner via a first end on the outlet tube 820 of the collection tube. In the example shown, the cylinder is mounted via its cylinder on the support, the end of its rod is fixed to a collar 891*a* of the evacuation tube, the latter being thus carried by the cylinder rod and positioned in parallel to the cylinder. The support 892 is advantageously mounted on the fixed frame via a flexible fastening system 894, for example of the silentbloc type, in order to compensate a possible gap in the alignment of the axes of the outlet tube and of the evacuation tube. The evacuation tube is connected via a flexible duct to the sewage system or to a circuit provided with a pump for the recycling in closed circuit of the cleaning agent towards the tank.

According to an embodiment, the evacuation tube is connected, more preferably directly, without a system for intermediate pumping, to a cleaning unit used to prepare cleaning solutions, send them into the tank of the filling machine, recover them and possibly recycle them. Advantageously, the cleaning unit is able to circulate a cleaning solution in the reverse direction, the cleaning solution flowing into the collection tube then in the collecting elements, in the direction of the spouts. An alternation between gravitational flow and flow, referred to as counter-current flow, of the cleaning solution makes it possible to increase the effectiveness of the cleaning by a faster and safer separation of the traces of filling product, in particular on the lower edge of the filling spouts, and in particular in the grooves 322 of the spouts.

Figure 7:
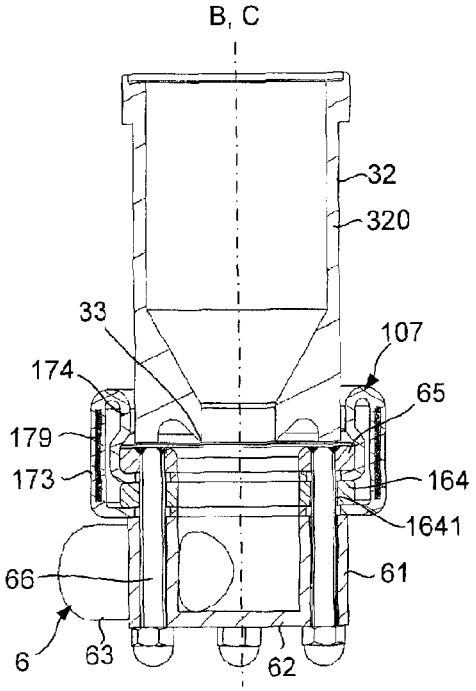
FIG. 7 is a view analogous to that of FIG. 5B, showing a collecting element according to a first alternative embodiment.

FIG. 7 shows an alternative embodiment wherein an inflatable membrane 107 is mounted as previously by means of a ring 164 and a flange, the ring 164 being formed only of a horizontal annular wall 1641, without vertical cylindrical wall. The membrane is moulded in its form shown in FIG. 7, and its elasticity is defined in such a way that it is deformed laterally towards the interior when it is inflated, without requiring a prop, to come to tighten the spout. The membrane can also have zones of different elasticity in order to obtain a more substantial deformation of its internal portion in its inflated state. The internal portion 174 of the membrane is for example formed of an elastomer material having an elasticity that is higher than that of the elastomer material constituting the external portion 173 of the membrane. Alternatively, such as is shown in FIG. 7, the external portion 173 comprises a reinforcement 179, for example formed of a strip of fabric embedded in the elastomer material.

Figure 8:
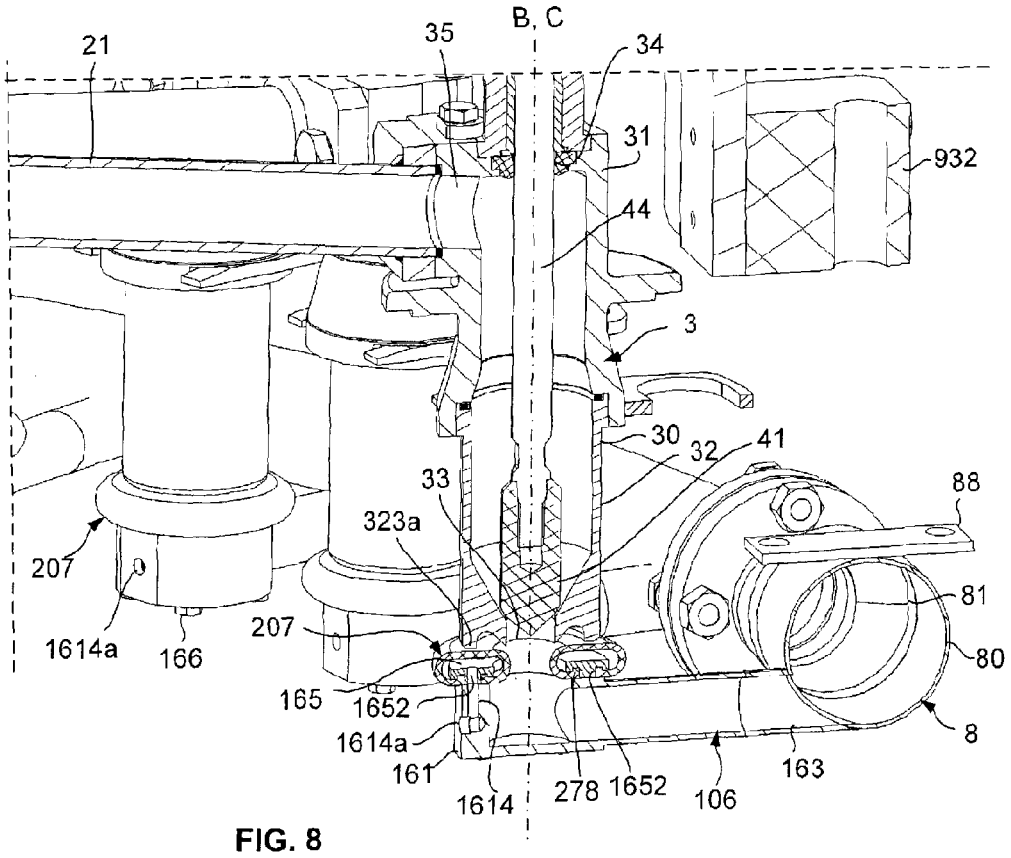
FIG. 8 is a view analogous to that of FIG. 3, showing a collecting element according to a second alternative embodiment.

FIG. 8 shows a second alternative embodiment wherein an annular inflatable membrane 207 is mounted by means of an annular flange 165. The membrane is provided on its circular internal edge and on its circular external edge with a peripheral bead 278. The membrane covers the upper face of the flange and its internal and external edges are brought to the side of the internal face of the flange, and its peripheral beads are housed in annular grooves 1652 arranged on the internal face of the flange, on either side of a central circular rib of the flange.

Each collecting element 106 comprises as previously a first tube 161 and a second tube 163, and is mounted on the collection tube 8. The flange provided with the membrane is placed against the upper edge 611 of the first tube by its central circular rib, and tightened as previously by the bottom of the collecting element using screws 166. The cylindrical wall of the first tube is provided with longitudinal bores extending from its lower edge to its upper edge. Each screw is inserted, from the lower edge, into a longitudinal bore of the cylindrical wall of the first tube, and is screwed into a threaded blind hole arranged in the circular rib of the flange. When the flange is tightened, the circular edges of the flange are tightened between the upper edge and the flange.

The inflatable membrane can be inflated by injecting a fluid under pressure passing in a first channel 1614 arranged in the thickness of the cylindrical wall of the first tube and in a second vertical channel 1652 arranged in the flange that exits inside the membrane. The first channel 614 extends horizontally towards the interior from the exterior surface of the cylindrical wall of the first tube, opposite the second tube, then vertically upwards to exit onto the upper edge, on second channel 1652 of the flange. The supply in fluid is carried out from the orifice 1614*a* of the first channel on the cylindrical wall.

When the collector tube is in service position, the membrane 207 in inflated state comes to press against the lower edge 323*a* of the skirt 323, around the discharge opening 33, without contact with the latter. The displacement of the collection tube from its retracted position to its service position can be carried out as previously, or only through vertical translation downwards then rotation by one half pitch, without additional vertical translation upwards. The service position then corresponds to the aforementioned second low position, the membrane then being able to be deformed enough during the pressurising to thrust itself against the collecting elements and provide a sealed contact between collecting elements and the spouts.

Figure 9:
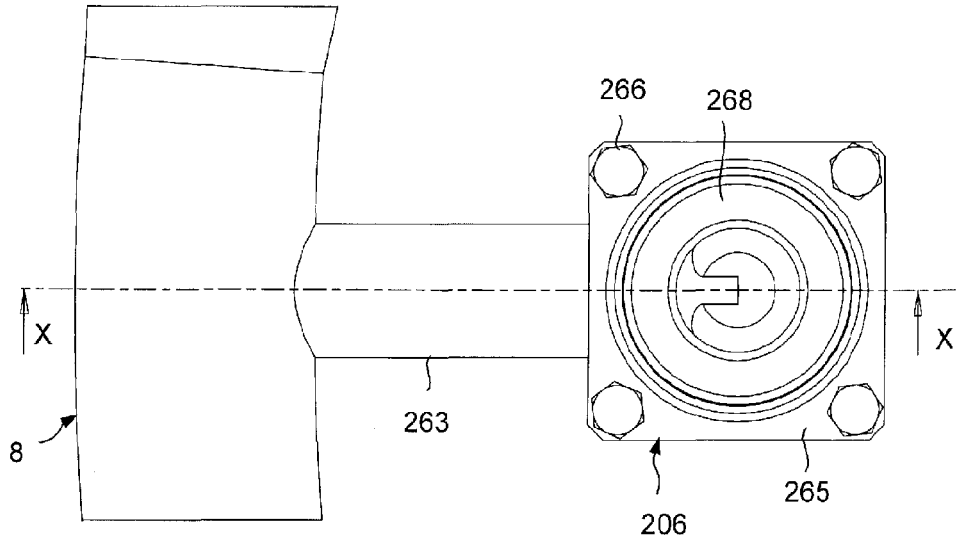
FIG. 9 is a top view of a collector according to a third alternative embodiment; and, FIG. 10 is a cross-section view according to the section plane X-X of FIG. 9.
Figure 10:
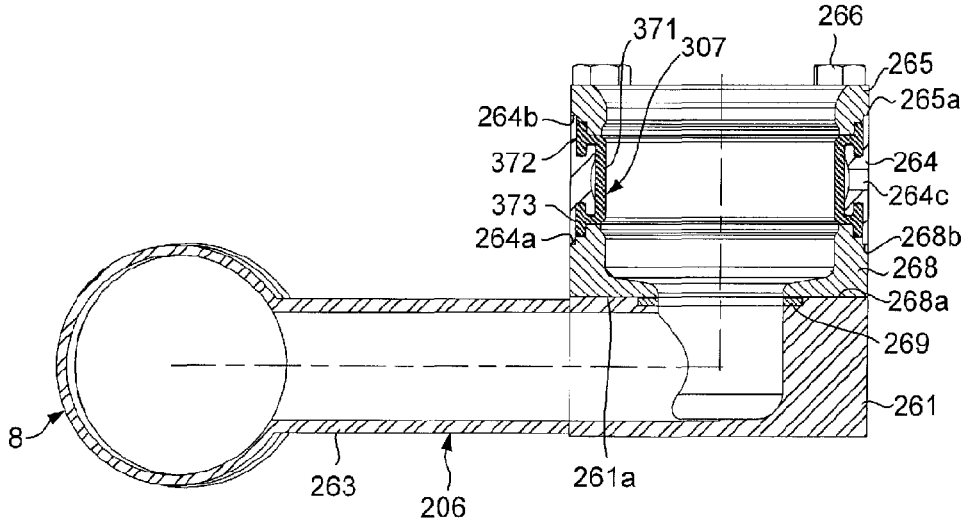

FIGS. 9 and 10 show a third alternative embodiment wherein an annular inflatable membrane 307 is mounted by means of a first ring 268, a second ring 264 and an annular flange 265. Each collecting element 206 comprises as previously a first tube 261 and a second tube 263, and is mounted on the collection tube 8.

The membrane 307 comprises a vertical cylindrical main wall 371 extending at each end towards the exterior via a mounting lug 372, 373 with a T-shaped section. Each lug is connected by the leg of the T, with the branch of the T being arranged substantially vertically.

The first ring 268 comprises an annular horizontal wall extending on its exterior edge via an annular vertical wall. The second ring 264, formed from an annular vertical wall, is mounted by its lower edge 264*a* against the upper edge 268*b* of the vertical wall of the first ring 268, said edges 264*a*, 268*b* being conformed to form together a T-shaped housing for the reception of the lower lug 373 of the membrane 307. The annular flange 265 is mounted by its lower edge 265*a* against the upper edge 264*b* of the second ring 264, said edges 264*b*, 265*a* being conformed to form together a T-shaped housing for the reception of the upper lug 372 of the membrane.

For its mounting, the membrane 307 is mounted on the second ring 264, the internal portions of the branches of the lugs 372, 373 being housed in grooves of the upper and lower edges 264*a*, 264*b* of the second ring. The flange 265 and the first ring 268 are then placed on either side of the second ring. The cylindrical internal passages of the two rings and of the flange form a cylindrical housing to receive the spout. The two rings and the flange have exteriorly a rectangular or square shape in order to allow for their assembly by their corners on the first tube 261. The unit formed of the two rings, of the flange and of the membrane is placed on the first tube, the lower edge 268*a* of the annular wall of the first ring against the upper edge 261*a* of the first tube, a flat seal 269 being inserted between the two edges 268*a*, 261*a*. The whole is tightened by the top by means of four screws 266 passing in bores arranged in the four corners of the flange 265, of the second ring 264 and of the first ring 268, and screwed into threaded blind holes arranged on the upper edge 261*a* of the first tube.

For the inflating of the membrane, the second ring has a channel 264*c* passing its tubular wall on either side. The supply in fluid under pressure is carried out from the exterior orifice of the channel which is arranged substantially opposite the second tube 263.

During its movement from its second low position to its service position, the spout penetrates into the flange 265 and the two rings 264, 268, the membrane being in a deflated state, such as is shown in FIG. 10. In the service position, the membrane 307 is arranged around the cylindrical wall 320 of the second part 32 of the spout. The lower edge 323*a* of the spout is arranged just above the horizontal wall of the first ring 268. In inflated state, the membrane comes to press against the cylindrical wall of the spout.

Although the invention has been described in liaison with a particular embodiment, it is obvious that it is in no way limited to this and that it comprises all of the technical equivalents of the means described as well as combinations thereof if the latter fall within the scope of the invention.

The invention claimed is:

1. Machine for filling containers comprising several filling stations each comprising a filling spout connected to means for distributing filling liquid, and a cleaning device comprising several individual tubular collecting elements, each said collecting element comprising an internal passage extending from an upstream end to a downstream end, and being able to come in contact by said upstream end against a filling spout, a collection tube whereon are mounted rigidly said collecting elements via their downstream end, and moving means able to move said collection tube between a service position wherein the individual collecting elements are in contact via the upstream end against the filling spouts, and a retracted position wherein said collecting elements are separated from the filling spouts, wherein said collection tube laterally carries said individual collecting elements in such a way that, in the retracted position of the collection tube, said collecting elements are arranged between the filling spouts, the moving means being able to move said collection tube from said retracted position towards said service position by at least one displacement in vertical translation downwards, parallel to longitudinal axes of the filling spouts, followed by a horizontal movement, perpendicularly to the longitudinal axes of the filling spouts, in such a way that the upstream end of each said collecting element is substantially centered according to the longitudinal axis of a filling spout.

2. Machine according to claim 1, wherein the collecting elements and the collection tube are arranged substantially on or above lower edges of the filling spouts in the retracted position of the collection tube.

3. Machine according to claim 1, wherein in order to bring the collection tube into said service position, the horizontal movement is followed by a movement in vertical translation upwards, parallel to the longitudinal axes of the filling spouts.

4. Machine according to claim 1, wherein the machine is of the rotating type, said filling stations being arranged at regular angular intervals on a support structure mounted rotatingly on a fixed frame, said collection tube is of a generally annular shape and laterally carries, at regular angular intervals, the individual collecting elements, said collection tube being mounted mobile on said support structure via said moving means, and said moving means being able to move the collection tube in vertical translation and in rotation, said horizontal movement consisting in a rotation around an axis of rotation of the support structure.

5. Machine according to claim 4, wherein each individual collecting element comprises a first vertical tube having a vertical axis, comprising an open upper end constituting said upstream end of the collecting element and a lower end closed by a substantially horizontal wall, and a second tube integral with the first tube, of which the internal passage exits via a first end into the internal passage of the first tube, and a second end constituting the second end of the collecting element through which the collection element is fixed radially to the annular collection tube.

6. Machine according to claim 5, wherein said second tube extends radially towards an interior from the collection tube, and the collection tube is arranged on an exterior side of a circle described by the axes of the filling spouts.

7. Machine according to claim 5, wherein the collection tube comprises an evacuation outlet, the collection tube comprising two symmetrical branches, extending from said evacuation outlet, and being connected at an opposite end to said evacuation outlet, the internal passage of each said branch having a transversal section increasing from an end opposite said evacuation outlet, in the direction of said evacuation outlet, and said ends of the branches being closed.

8. Machine according to claim 5, wherein the moving means include at least two carriages to which are assembled the collecting tube, the collection tube being assembled to each said carriage by at least one vertical raising/lowering cylinder, said carriages being mounted slidingly on a circular horizontal guiding rail integral with the rotating support structure, and at least one swing cylinder being mounted between the support structure and one of the carriages.

9. Machine according to claim 5, wherein the machine comprises a general evacuation device integral with the fixed frame, comprising an evacuation tube able to substantially face the evacuation outlet of the collection tube when the collection tube is in said service position and the support structure in a given fixed position, and said evacuation tube being able to be moved in horizontal translation between a separated position and an active position wherein said evacuation tubes comes to connect onto the evacuation outlet of the collection tube.

10. Machine according to claim 1, wherein said upstream end of each said collecting element is provided with sealing means through which said collecting element comes into contact with a filling spout, and said sealing means comprising an annular inflatable membrane mounted at the upstream end of the collecting element and able to come into contact with the filling spout when said inflatable membrane is in an inflated state and the collection tube is in said service position.

11. Machine according to claim 10, wherein said inflatable membrane is able to come laterally tighten a cylindrical wall of the filling spout.

12. Machine according to claim 10, wherein the inflatable membrane of a collecting element is mounted on an upper edge of the first tube of the collecting element by at least one flange fixed on said first tube by screws or threaded rods.

13. Machine according to claim 4, wherein each said filling station comprises a device for supporting a container, said support structure of the machine comprising an upper column carrying at an upper end, the means of distribution and the filling spouts, and a lower column carrying the support devices, and wherein is mounted slidingly the first column, the upper column being able to be moved between a low position for the filling operations and a high position in order to separate said support devices from the filling spouts for the cleaning operations.

* * * * *